US006023918A

United States Patent [19]

Czepluch

[11] Patent Number: 6,023,918

[45] Date of Patent: Feb. 15, 2000

[54] PRODUCT PACKAGING DEVICE

[76] Inventor: Jörg Czepluch, Kleiner Moorweg 34, D-25436 Tornesch, Germany

[21] Appl. No.: 09/097,633

[22] Filed: Jun. 16, 1998

[30] Foreign Application Priority Data

Jun. 17, 1997 [DE] Germany ..... 197 25 526

[51] Int. Cl.[7] ..... B65B 9/10; B65B 51/14

[52] U.S. Cl. ..... 53/551; 53/552

[58] Field of Search ..... 53/551, 552, 553, 53/554, 567

[56] References Cited

U.S. PATENT DOCUMENTS

| | | | |
|---|---|---|---|
| 3,055,154 | 9/1962 | Markley | 53/551 |
| 4,241,563 | 12/1980 | Muller | 53/552 |
| 4,537,012 | 8/1985 | Groom | 53/552 |
| 4,598,533 | 7/1986 | Takagaki | 53/552 |
| 4,729,210 | 3/1988 | Galliano | 53/551 |

OTHER PUBLICATIONS

Neue Verpackung Oct. 1991, "Innovationstrends bei Verpackungsmaschinen dargestellt am Beispiel der Schlauchbeutelmaschinen", von Dr.–Ing. G. Bleisch und Dipl.–Ing. F. Weile, pp. 24–42.

*Primary Examiner*—John Sipos
*Attorney, Agent, or Firm*—Harness, Dickey & Pierce, P.L.C.

[57] ABSTRACT

The present device serves for packaging products and is equipped with a product supply line and a packaging means supply line for a tube-like packaging material. In addition, the present device is equipped with at least two sealing elements that after a filling can be moved relative to one another. At least one of the sealing elements contains a thermal sealing element for executing the sealing process. Two sealing pairs of sealing elements are situated opposed one another on separate carriers. Provision is made in each instance for separate controls for the opening and closing movements and the adjusting movements of the carriers. When a contra-rotating movement of the carriers occurs, one of the sealing pairs will be opened at least during positioning on an identical carrier level of one of the sealing pairs and the other sealing pair will be closed. By this means the sealing elements of the opened sealing pair are guided lateral to the sealing elements of the closed sealing pair.

9 Claims, 5 Drawing Sheets

PRODUCT PACKAGING DEVICE

BACKGROUND AND SUMMARY OF THE INVENTION

The present invention relates to a product packaging device which has a product supply line and a supply line for packaging materials for a tube-like packaging material and which in order to seal off the packaging material after a filling, is equipped with at least two sealing elements movable relative to one another, of which at least one of them has a thermal sealing element for carrying out the sealing process.

Such devices are used, for example, to fill fruits or vegetables in reticulated or tube-like packaging materials. After a set quantity of the product is fed in, the tube-like packaging material in each instance through the effect of heat is provided with sealing points at right angles to the longitudinal direction of the packaging material, at which points the individual packaging bags can subsequently be separated.

The impact of the thermal sealing element as a rule occurs in such a manner that first the sealing elements with clamping jaws are moved toward one another and then clamp the packaging material in the region for the intended sealing. Following this, the thermal sealing element is activated and the fusing process is carried out. After the thermal sealing element has been deactivated, it is necessary, in order to achieve a satisfactory stabilization of the material, to apply pressure for a given length of time.

Because of the need for a stabilization period following the active thermal sealing, the speed of the packaging process suffers. For this reason it is also known in the art for several pairs of sealing elements to be employed, so that the packaging process can continue during this rest phase. Typically, during the rest phase the sealing elements are moved with the clamped material to be packaged out of the sealing position and an additional pair of sealing elements is simultaneously moved in the direction of and into the sealing positioning. These types of packaging devices with two pairs of sealing elements are summarized, for example, in the journal Neue Verpackung 10/91 pp. 24–41 in the article "Innovationstrends bei Verpackungsmaschinen dargestellt am Beispiel der Schlauchbeutelmaschinen" (Innovative Trends in Packaging Machines as Illustrated by the Example of Tube Bag Machines).

The relevant packaging devices cannot meet all demands, however, such as a high packaging speed and reliability and stability against disruptions that are placed on these machines.

The object of the present invention, accordingly, is to construct a device of the type mentioned above in such a manner that it will carry out the packaging process at a high speed and also will offer good reliability and adaptability when put to various applications.

This object is solved in the present invention by locating two pairs of sealing elements facing each other on separate carriers, by providing for two separate controls each for the opening and closing movements of respective pairs of sealing elements and adjustment movements of the carriers and by having one of the sealing pairs opened and the other one closed when the carriers are moving in counter directions to one another at least during positioning on the same carrier level, with the result that the sealing elements of the opened sealing pair are guided lateral to the sealing elements of the closed sealing pair.

By the use of separate controls for the opening and closing movements of the sealing elements on the one hand and the adjustment movements on the other it is possible, for example, to execute the prescribed opening and closing movements of the sealing elements with a horizontal movements of the sealing elements and a vertical positioning of the carriers to any positions desired along the vertical movement of the carriers. Through this means the batch to be fashioned from the tube-like packaging material can be adapted to various sizes of batches.

In that the closed sealing pair and the opened sealing pair are guided by one another a simple kinematic operation is realized, which guarantees a high degree of reliability even under adverse conditions of use. This simple kinematic operation also supports the processes of movement to ensue a high speed. In addition, closed rotation routes can be set for the sealing pairs, so that the forward and backward movements delaying the courses of movement can be avoided.

A forced synchronization for purposes of mechanical simplicity can be achieved by letting the sealing elements of each sealing pair be moved in contra-rotation relative to one another.

One robust embodiment is provided by having guide rods situated parallel to one another for performing an opening and closing movement of the sealing elements.

In addition, a high degree of security in operation can be afforded by locating vertical rods for executing a vertical adjustment of the mounting plates supporting the sealing pairs.

The manner in which the mounting plates are guided rotating in opposite directions in equilibrium makes low wear and tear operation possible as well as minimizes energy consumption.

In one simple embodiment the product supply line is formed in the shape of the inside of a tube.

The number of structural elements used can also be reduced by letting the supply line of packaging material be formed in the shape of the outer surface of a tube.

A forced synchronization in carrying out the opening and closing movements can be achieved by coupling the carrier arms for holding the sealing elements together with one another by means of pivoting levers.

It is suggested for purposes of guaranteeing a short cycle period that the thermal sealing element is guided to seal a batch already filled in an upper region simultaneously with a batch not yet filled in a lower region.

A further simplification in function can be achieved by coordinating the operating sequence in such a manner that the sealing pairs are equipped with a control for coordinating a simultaneous hold on one sealing area of the packaging material and a withdrawal of a batch to be refilled from the packaging materials supply line.

High flexibility in adapting to various batch sizes is also achieved by having the sealing pairs connected to a control for signaling an opening movement when a set section of a vertical movement has been reached.

BRIEF DESCRIPTION OF THE DRAWINGS

A schematic illustration of various embodiments of the invention are shown in the drawings. The following is shown.

DESCRIPTION OF THE PREFERRED EMBODIMENT

Figure 1:
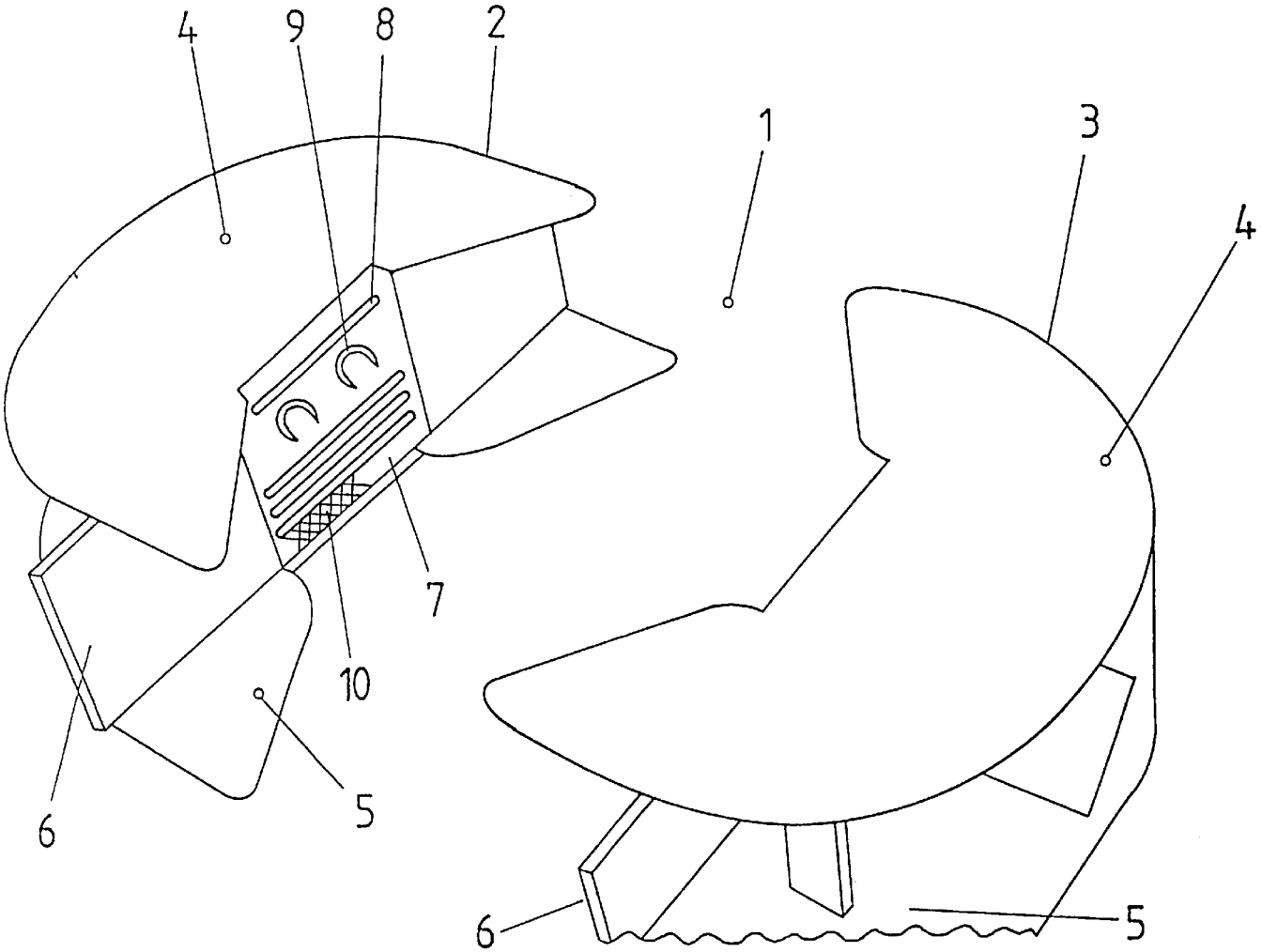
FIG. 1 is a perspective representation of a sealing pair with two sealing elements and a thermal sealing element.

FIG. 1 shows a sealing pair (1), which consists of two sealing elements (2, 3) located opposite to one another. The sealing elements (2, 3) each consist of base plates (4, 5) located opposite one another and front plates (6). In the region of the front plates (6) are located thermal sealing elements (7). The thermal sealing elements (7) are designed with profiling (8) and punch segments (9). In addition a surface area of the thermal sealing elements (7) can be equipped with a surface structure (10) that lends support to a longitudinal fixing of the packaging material capable of being stressed in the region of a closed sealing pair (1).

Figure 2:
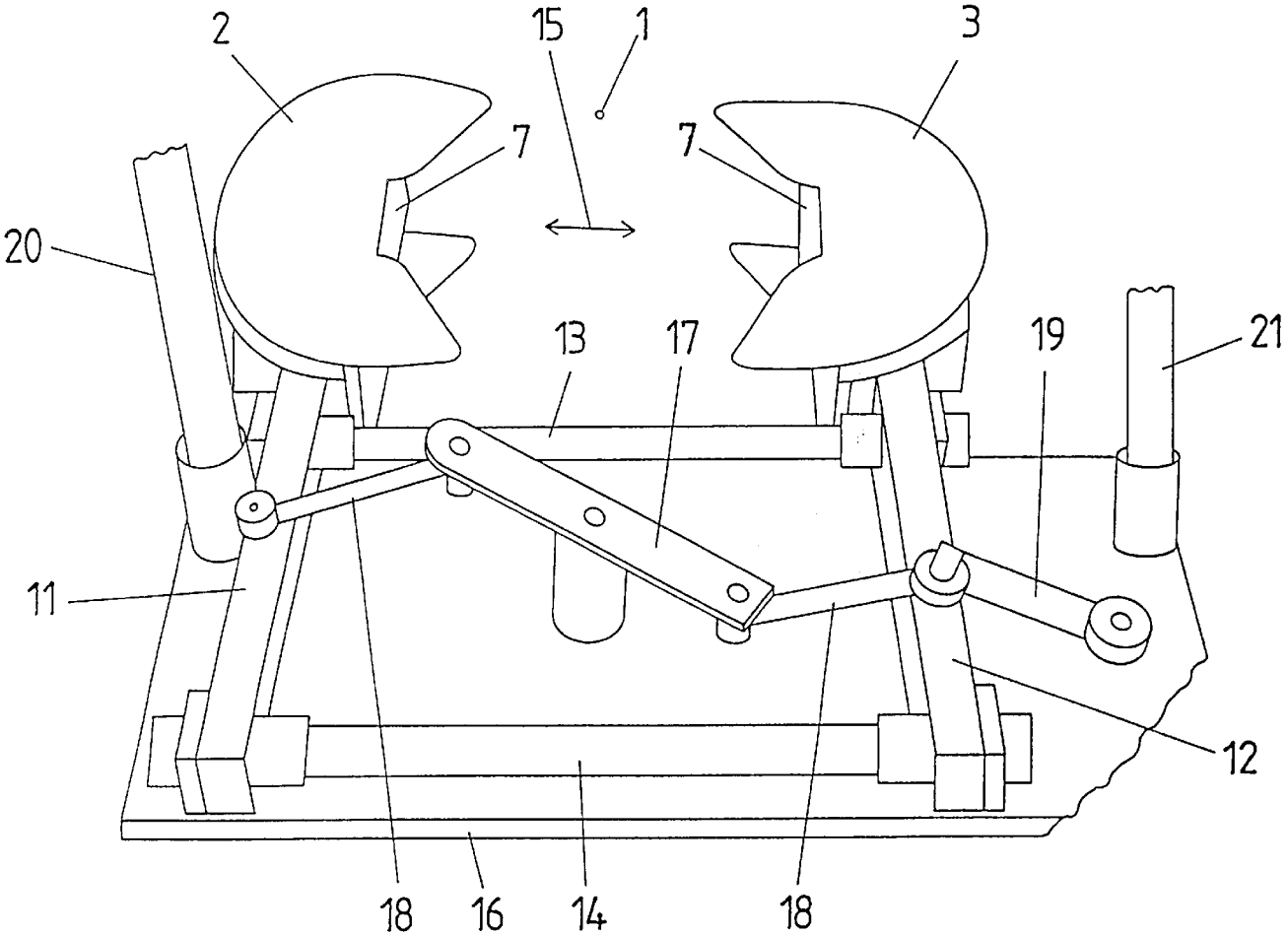
FIG. 2 is a perspective view of a carrier with one sealing pair and mechanical coupling elements for coordinating the movements of the sealing elements.

FIG. 2 shows an adjustment mechanism for positioning the sealing elements (2, 3) of the sealing pair (1). The sealing elements (2, 3) are held by carrier arms (11, 12), which can be positioned along guide rods (13, 14) in a direction of adjustment (15). The carrier arms (11, 12) overhang a mounting plate (16) in the region of the sealing elements (2, 3).

The carrier arms (11, 12) can be positioned by means of pivoting levers (17, 18, 19). The pivoting levers (17, 18, 19), (with a simple mechanical design) cause a forced coupling of the sealing elements (2, 3). The mounting plate (16) can be positioned along the vertical rods (20, 21).

Figure 3:
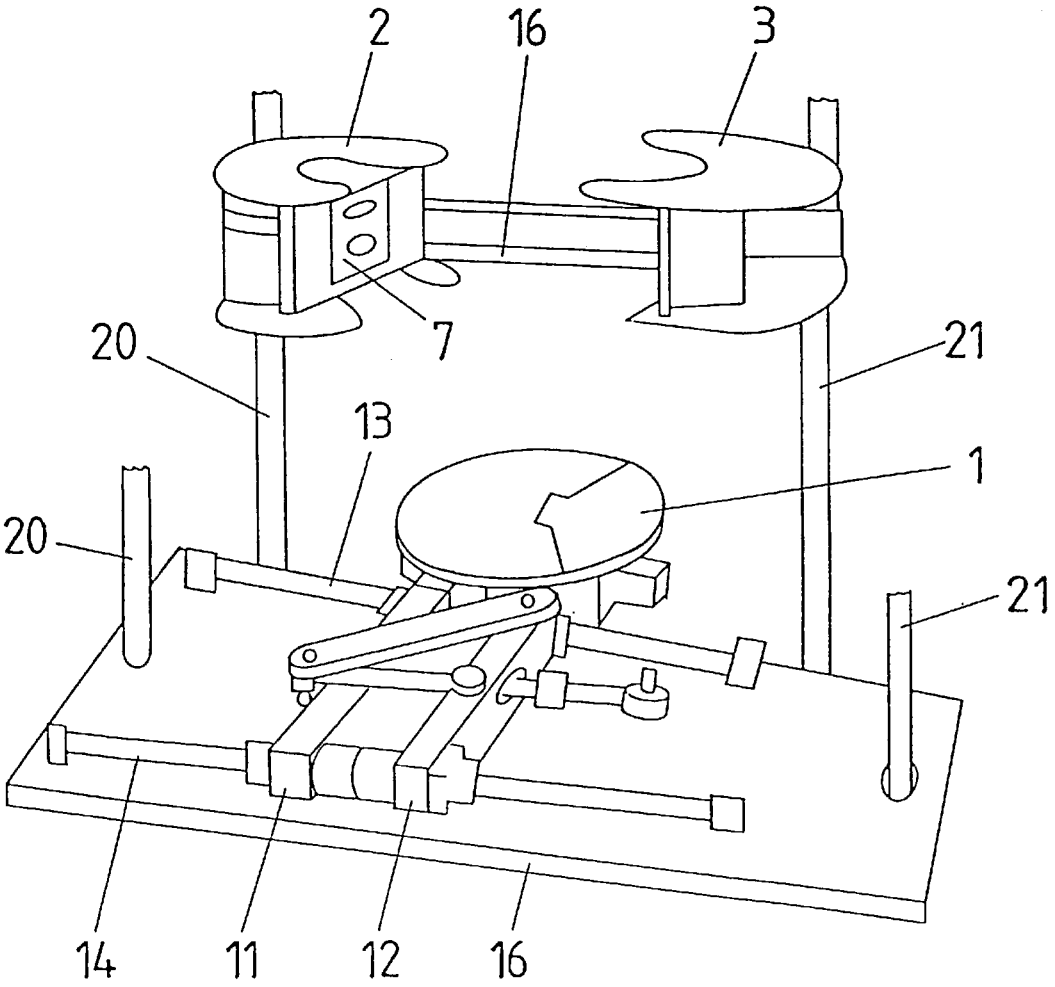
FIG. 3 is a perspective representation of the device with two sealing pairs, with the lower sealing pair closed and the upper sealing pair closed.

FIG. 3 in the lower section of the drawing shows a mounting plate (16) as in FIG. 2 in a lowered state with a closed sealing pair (1) and an additional mounting plate (16) in an elevated state with an opened sealing pair (1). Provision has been especially made for the mounting plates (16) to be coupled with one another in respect of their vertical movements in such a manner that equilibrium will be achieved. If one of the mounting plates (16) is elevated, this will cause a synchronous lowering of the other mounting plate (16). As in the positioning of the sealing pairs (1) as shown in FIG. 3, it is possible because of the respective overhang over the mounting plates (16) of the sealing pairs (1) to guide the closed sealing pair (1) between the sealing elements (2, 3) of the opened sealing pair (1). An actual sequence of movements is designed so that the lower sealing pair (1) is opened first and the upper sealing pair (1) will be closed. The opening and closing positioning of the individual sealing pairs (1) as shown in FIG. 3 is thus interchanged before the beginning of the movement sequence.

Figure 4:
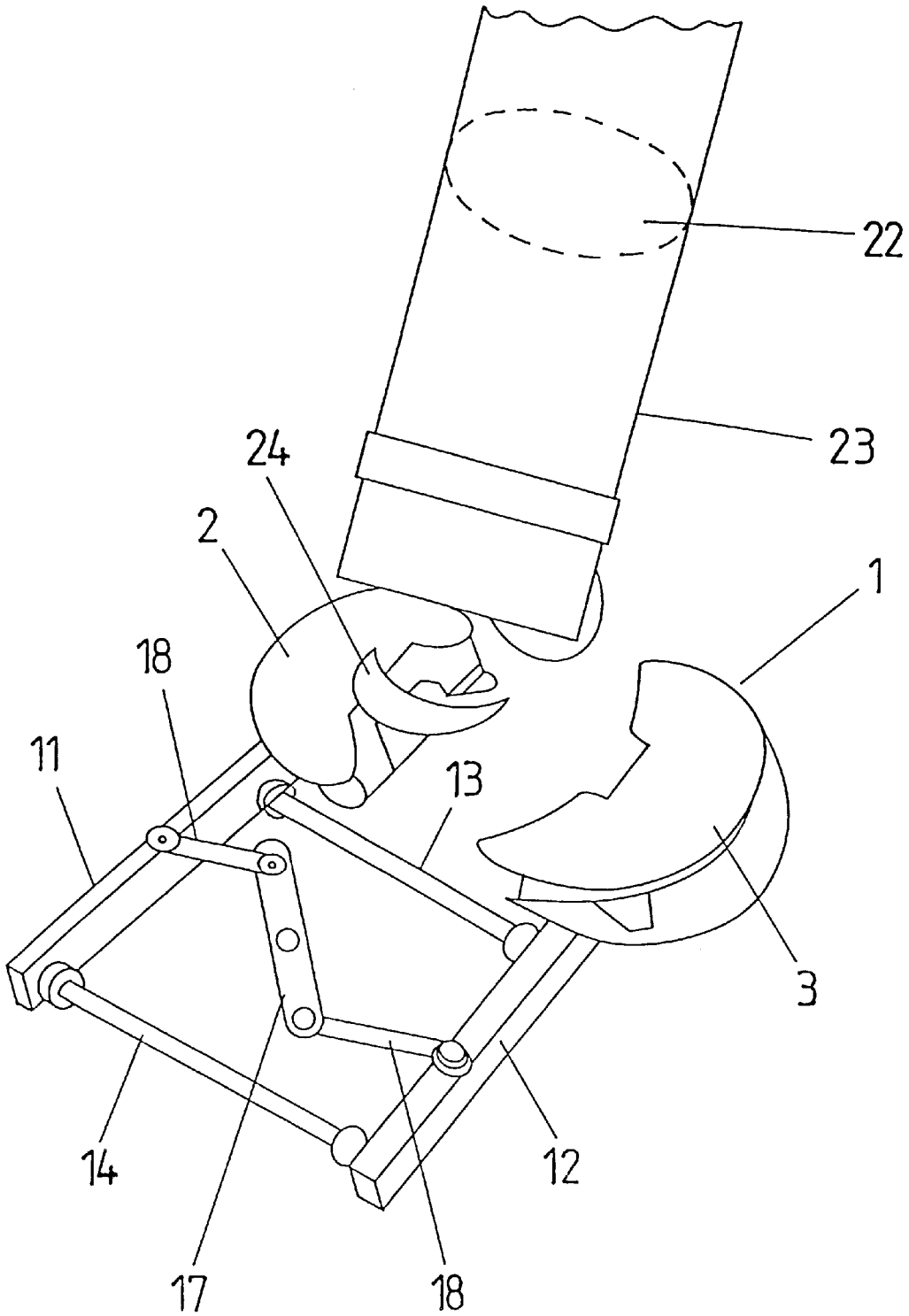
FIG. 4 is a perspective representation of a sealing pair with coordinated supply lines for product and packaging materials.

FIG. 4, with an opened sealing pair (1), illustrates the spatial arrangements of a product supply line (22) in the shape of a tube. The outer surface of the product supply line (22) is constructed so as to be the supply line for the packaging material (23). This makes it possible to guide the products to be packaged through the inside of the tube into the region of a feed-in funnel (24) and simultaneously to pull off the tube-like packaging material, as a packaging net, from the outside of the tube.

Figure 5:
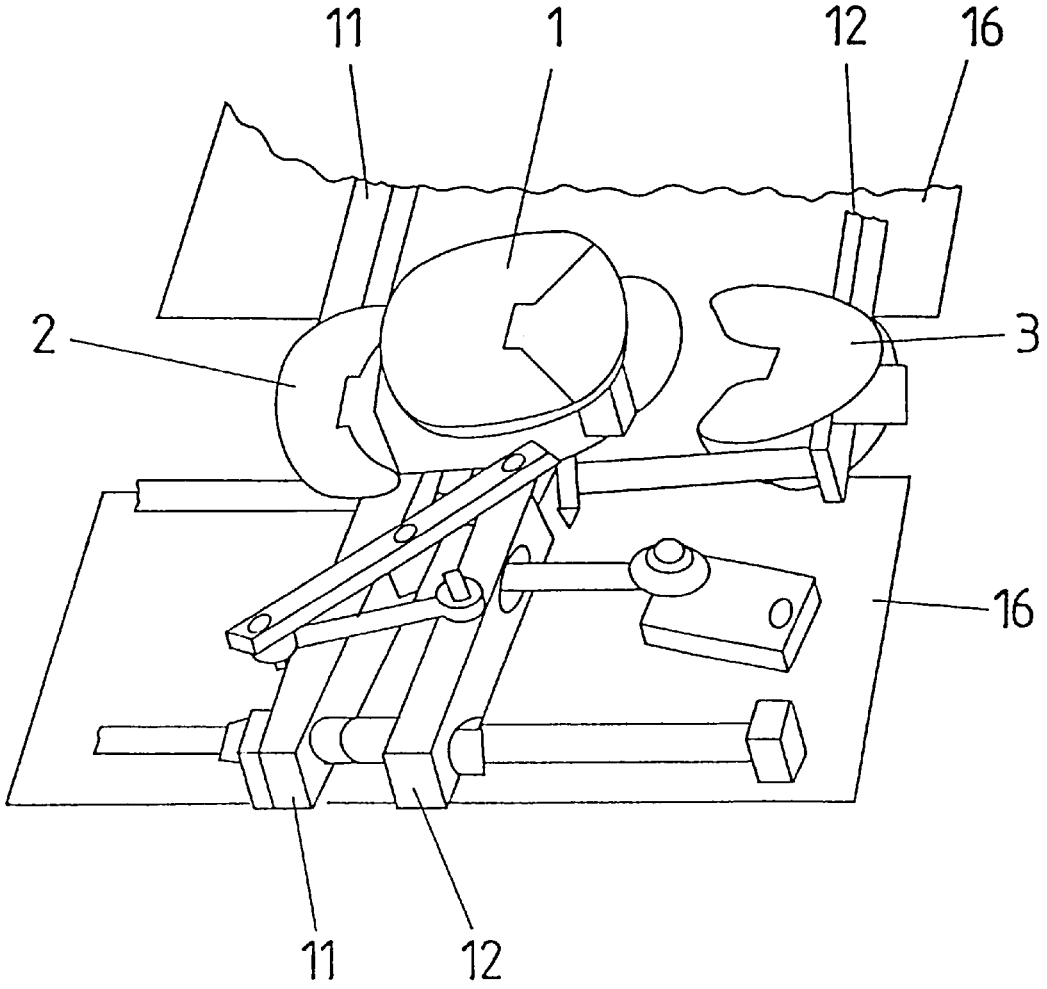
FIG. 5 is a simplified representation for purposes of illustrating the passing, movement of a closed sealing pair between the sealing elements of an opened sealing pair.

FIG. 5 shows in a simplified illustration the arrangement according to FIG. 3 following a synchronous elevation of the lower mounting plate (16) after a prescribed opening of the sealing pair (1) and a lowering of the upper mounting plate (16) after a prescribed closing of the assigned sealing pair (1), as seen from the direction toward FIG. 3 from behind. In the operational position shown the mounting plates (16) have not yet been guided past one another and the lower closed sealing pair (1) as in FIG. 3 after the opening movement has not yet reached a higher level than the closed sealing pair (1) as shown in FIG. 4.

The sequence of functions in carrying out the packaging process can be more easily understood from the illustration shown in FIG. 3. With the positioning shown in the illustration, the packaging material (not shown) would be held by the lower sealing pair (1) and sealed in such a manner than the batch to be refilled in the lower region is already closed off. The products to be filled can reach the area of the batch through the opened sealing pair (1).

After the filling process is completed, the upper sealing pair (1) is closed and simultaneously executes the sealing of the upper end of the batch already filled and of the lower end of the next batch to be filled. After the lower sealing pair has been opened, the upper closed sealing pair with clamped-in packaging material can be positioned downward and draws off additional packaging material at a prescribed length from the packaging material supply line (23). After a prescribed final position has been reached, the next packaging sequence can occur.

For purposes of producing a high degree of firmness in the region of the closed batch, it is possible, for example, to include a conveyor belt in additional to the tube-shaped packaging material in the packaging sequence. The conveyor belt will also extend in the longitudinal direction of the packaging material and is connected to the packaging material during the sealing process. When reticulated packaging materials are used, a mechanical through-penetration of the reticulated packaging material can be achieved through the sealing process in the region of the places to be sealed by means of the conveyor belt.

In particular, it is also possible to employ two strips of conveyor belts parallel to one another, which are situated opposite one another in the area of the sealing points and are connected together. These belts can be laid in different lengths in the area of the product for filling. One of the belts makes it possible in its extended state to take on loads and the other, long belt, together with the packaging material, forms the contour of the batch and creates a gathering space for receiving the products.

I claim:

1. A device for the packaging of products comprising:

a hollow supply line for delivering a supply of products through the interior thereof and delivering a supply of packaging material along the exterior thereof;

first and second sealing elements supported on a first carrier for relative movement along a first direction between an open position and a closed position;

third and fourth sealing elements supported on a second carrier for relative movement along said first direction between an open position and a closed position;

said first and second sealing elements and said third and fourth sealing elements including a surface operative, when respective of said sealing elements are in a closed position, to support a portion of said packaging as it is being filled by said supply of product;

said first and second carriers being spaced apart in a second direction, each of said first and second carriers being movable along substantially parallel spaced axes, said first and second directions being generally perpendicular to each other and extending parallel to a first plane, said spaced axes being generally perpendicular to said first and second directions;

separate controls operable to open and close each of said first and second and said third and fourth sealing elements and to effect movement of said first and second carriers in opposite directions along said spaced axis, said controls being operable to position said first and second sealing elements in an open position and said third and fourth sealing elements in a closed position at least at such time that said first, second, third and fourth sealing elements are positioned within the same plane;

said first and second sealing elements and said third and fourth sealing elements being operative to support said packaging material during movement along said axis when in a closed position;

first and second pairs of generally parallel elongated laterally spaced carrier rods mounted on said first carrier and said second carrier laterally of said supply line; and first pair of carrier arms extending between and movably supported on said first pair of guide rods, said first and second sealing elements being supported on respective ones of said first pair of carrier arms, and a pivoting lever assembly interconnecting said first pair of carrier arms to effect movement of said sealing arms between open and closed positions.

2. A device as set forth in claim 1 wherein one of said first and second and said third and fourth sealing elements is moved from said closed position to said open position while the other of said first and second and said third and fourth sealing elements is moved to said open position.

3. A device as set forth in claim 1 further comprising first and second pairs of elongated laterally spaced guide rods supported on respective ones of said carriers, said first and second sealing elements being movably supported on said first pair of guide rods and said third and fourth sealing elements being movably supported on said second pair of guide rods.

4. A device as set forth in claim 1 wherein said first and second carriers are moved simultaneously in opposite directions along said carrier rods.

5. A device as set forth in claim 1 wherein said product supply line is in the form of a tube.

6. A device as set forth in claim 1 wherein said supply of packaging material is in the form of an elongated tube.

7. A device as set forth in claim 1 further comprising a thermal sealing element provided on one of said first, second, third and fourth sealing elements, said thermal sealing element being operative to simultaneously seal an already filled portion of said packaging material along one end and a next adjacent portion of packaging material which is not yet filled.

8. A device as set forth in claim 7 wherein said first and second sealing elements are operative to simultaneously hold a portion of said packaging material adjacent said seal and draw off another portion of said packaging material to be filled from said supply of packaging material.

9. A device as set forth in claim 1 wherein said controls operate to effect movement of said first and second sealing elements from a closed position to an open position when said first carrier reaches a predetermined location along said axis.

* * * * *

UNITED STATES PATENT AND TRADEMARK OFFICE

CERTIFICATE OF CORRECTION

PATENT NO. : 6,023,918

DATED : February 15, 2000

INVENTOR(S) : Jörg Czepluch

It is certified that error appears in the above-identified patent and that said Letters Patent is hereby corrected as shown below:

Column 1, line 39, "positioning" should be --position--.

Column 4, line 30, "additional" should be --addition--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*